US010875038B2

(12) United States Patent
Lin et al.

(10) Patent No.: US 10,875,038 B2
(45) Date of Patent: Dec. 29, 2020

(54) MASSAGE WATER OUTLET DEVICE

(71) Applicant: XIAMEN SOLEX HIGH-TECH INDUSTRIES CO., LTD., Fujian (CN)

(72) Inventors: Fengde Lin, Fujian (CN); Mingfu Zhang, Fujian (CN); Tianming Wang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 147 days.

(21) Appl. No.: 15/989,804

(22) Filed: May 25, 2018

(65) Prior Publication Data

US 2019/0039079 A1 Feb. 7, 2019

(30) Foreign Application Priority Data

Aug. 1, 2017 (CN) ..... 2017 1 0646985

(51) Int. Cl.

| | |
|---|---|
| ***B05B 3/04*** | (2006.01) |
| ***B05B 1/18*** | (2006.01) |
| ***B05B 1/16*** | (2006.01) |
| ***B05B 12/04*** | (2006.01) |

(52) U.S. Cl.

CPC ..... *B05B 3/04* (2013.01); *B05B 1/1636* (2013.01); *B05B 1/1645* (2013.01); *B05B 1/18* (2013.01); *B05B 12/04* (2013.01)

(58) Field of Classification Search

CPC ..... B05B 3/04; B05B 1/1636; B05B 1/1645; B05B 1/18; B05B 12/04; B05B 1/267; B05B 1/185; B05B 3/008; B05B 3/0422; B05B 15/62; B05B 1/12; B05B 15/066; B05B 1/14; B05B 3/0418

See application file for complete search history.

(56) References Cited

U.S. PATENT DOCUMENTS

| | | | | |
|---|---|---|---|---|
| 8,403,240 | B2 * | 3/2013 | Chen | B05B 3/0422 239/240 |
| 9,067,222 | B2 * | 6/2015 | Gransow | B05B 1/12 |
| 9,975,128 | B2 * | 5/2018 | Zhou | B05B 3/04 |

* cited by examiner

*Primary Examiner* — Arthur O. Hall
*Assistant Examiner* — Steven M Cernoch
(74) *Attorney, Agent, or Firm* — Cooper Legal Group, LLC

(57) ABSTRACT

A slow area massage water outlet device has an impeller, a planetary gear speed reduction mechanism, a rotating water blocking plate, a water diversion member and a water outlet member; the planetary gear speed reduction mechanism is respectively communicated with the impeller and the rotating water blocking plate; the impeller is rotated by a planetary gear decelerating mechanism to rotate the water blocking plate; the water diversion member has at least two separately isolated water diversion cavities; one end of the water diversion cavity is a water inlet end and the other end is a water outlet end; the water outlet end of each of the water diversion cavities is respectively communicated with the water outlet holes of different areas in the water outlet member; the rotating water blocking plate has a water outlet and a water sealing surface.

7 Claims, 15 Drawing Sheets

MASSAGE WATER OUTLET DEVICE

FIELD OF INVENTION

The present invention relates to a water outlet device, and more particularly to a massage water outlet device.

BACKGROUND OF INVENTION

Existing massage water upgrade, the existing massage water are arranged in the same circle, plugging are very few, and the frequency is very fast, massage is not strong, therefore, planning a area slow water outlet, the tap is changed to more areas, the water outlet way is changed to sub-regional intermittent water outlet. With the accelerated pace of people's lives, the shower is no longer just a means of cleaning the body, but also a way to relieve fatigue decompression. Therefore, the modern showerhead is no longer satisfied with a single water outlet function, but various functions are realized by changing the shape of the water spray, the water outlet area, the intensity of the water outlet, and the like. One of the most important point is massage water. The traditional shower use intermittent water to achieve massage effect, but the frequency of intermittent water is very fast, the user is difficult to feel the effect of intermittent massage, the massage sensation of the massage water is relatively poor. Therefore, the regional slow massage water is given birth, this massage water has the following advantages: 1, the frequency is slow, to achieve a simulated manual percussion massage, the intermittent is strong, the massage effect is obvious. 2, it is sport water spray, the visual effect is good.

SUMMARY OF THE INVENTION

The main technical problem to be solved by the present invention is to provide a slow area massage water outlet device which has a relatively slow switching frequency of massage water, a strong massage sensation and can simulate a sense of strike.

In order to solve the above technical problem, the present invention provides a slow area massage water outlet device, comprising an impeller, a planetary gear speed reduction mechanism, a rotating water blocking plate, a water diversion member and a water outlet member;

the impeller is provided with a plurality of through holes in a direction of a rotation axis of the impeller; a water flow impacts the impeller to drive the impeller to rotate; and a water flow flows along the through holes toward the water diversion member;

the planetary gear reduction mechanism includes a fixed internal gear, a movable internal gear and a planetary gear;

the fixed internal gear and the movable internal gear are arranged coaxially, the movable internal gear and the rotating water blocking plate are interlockingly connected; the planetary gear is provided with a first gear and a second gear stacked in an axial direction; the first gear is meshed with the inner ring gear of the fixed inner gear, the second gear is meshed with the inner ring gear of the movable inner gear;

the impeller is provided with a plug column inserted into and connected with the planetary gear, the planetary gear is provided with a slot which is mated with and inserted into the plug column at the axis, so that the impeller and the planetary gear are linkedly connected;

the planetary gear rotates along the circumferential direction of the fixed internal gear and drives the movable internal gear to rotate in the axial direction; the rotating water blocking plate and the movable internal gear are arranged coaxially to link to each other, and when the movable internal gear rotates, the rotating water blocking plate rotates linkedly;

the bottom of the movable internal gear is a baffle, the baffle surface is provided with a plurality of through holes in the circumferential direction; the through hole connects the through hole of the impeller with the water passage of the linking member;

the water diversion member has at least two separately isolated water diversion cavities; one end of the water diversion cavity is a water inlet end and the other end is a water outlet end; the water outlet end of each water diversion cavity is respectively communicated with the water outlet hole of different area of the water outlet member;

the rotating water blocking plate has a water outlet and a water sealing surface; during the movement of the rotation water stop plate, the water outlet is communicated with the water inlet end of one of the water diversion cavities, and the water inlet end of the other water diversion cavities is toward the water sealing surface.

In a preferred embodiment: the rotating water blocking plate is also provided with a constant opening in the area where the water sealing surface is located, so that the water diversion cavity opposite to the water sealing surface still has a small amount of water to flow in.

In a preferred embodiment: the water diversion member comprises a water diversion plate and a water diversion body; the water diversion plate is arranged between the water diversion body and the water outlet member; the surface of the water diversion plate facing the water diversion body has a groove, the groove divides the surface of the water diversion plate facing the water diversion body into at least two areas;

the surface of the water diversion body facing the water diversion plate has a cavity corresponding to the area, and the outer circumference of the cavity has a convex rib correspondingly inserted into the groove; the convex rib is correspondingly inserted into the groove so that the water diversion plate and the water diversion body directly form the water diversion cavity.

In a preferred embodiment: there are at least two water flow channels isolated from each other in the water diversion body, the water flow channels are connected to the water diversion cavity to form the water inlet end.

In a preferred embodiment: the outlet holes of the water outlet member are arranged circularly; when the rotating water blocking plate rotates, the water outlet hole is divided into at least two areas according to the fan shape to alternately discharge water;

or, the water outlet holes of the water outlet member are arranged circularly, and when the rotating water blocking plate rotates, the water outlet holes are divided into at least two areas according to a concentric circle to alternately discharge water;

or, the water outlet holes of the water outlet member are arranged in an array, and when the rotating water blocking plate rotates, the water outlet holes in each row are divided into two areas according to odd numbers and even numbers, and water is alternately discharged.

The present invention also provides a slow area massage water outlet device, comprising an impeller, a speed reduction mechanism, a swinging water blocking plate, a water diversion member and a water outlet member;

the impeller is provided with a plurality of through holes in a direction of a rotation axis of the impeller; a water flow impacts the impeller to drive the impeller to rotate; and a water flow flows along the through holes toward the water diversion member;

the speed reduction mechanism is a racetrack-shaped rack, the rack is provided with a first tooth tip on an opposite side of the two straight sides of the racetrack;

the side of the impeller facing the rack extends a convex column at an axial center, a part of the side surface of the convex column is provided with a second tooth tip that is meshed with the first tooth tip;

when the impeller rotates, the rack drives the rack to swing left and right along a horizontal plane where the rack is located; both ends of the swinging water blocking plate are abutted against inner walls of two arc edges of the racetrack-shaped rack, when the rack is swung left and right, the swinging water blocking plate swings left and right;

the water diversion member has at least two separately isolated water diversion cavities; one end of the water diversion cavity is a water inlet end and the other end is a water outlet end; the water outlet end of each water diversion cavity is respectively communicated with the water outlet hole of different area of the water outlet member;

the swinging water blocking plate has a water outlet and a water sealing surface; during the movement of the swinging water blocking plate, the water outlet is communicated with the water inlet end of one of the water diversion cavities, and the water inlet end of the other water diversion cavities is toward the water sealing surface.

In a preferred embodiment: the swinging water blocking plate is also provided with a constant opening in the area where the water sealing surface is located, so that the water diversion cavity opposite to the water sealing surface still has a small amount of water to flow in.

In a preferred embodiment: the water diversion member comprises a water diversion plate and a water diversion body; the water diversion plate is arranged between the water diversion body and the water outlet member; the surface of the water diversion plate facing the water diversion body has a groove, the groove divides the surface of the water diversion plate facing the water diversion body into at least two areas;

the surface of the water diversion body facing the water diversion plate has a cavity corresponding to the area, and the outer circumference of the cavity has a convex rib correspondingly inserted into the groove; the convex rib is correspondingly inserted into the groove so that the water diversion plate and the water diversion body directly form the water diversion cavity.

In a preferred embodiment: there are at least two water flow channels isolated from each other in the water diversion body, the water flow channels are connected to the water diversion cavity to form the water inlet end.

In a preferred embodiment: the outlet holes of the water outlet member are arranged circularly; when the swinging water blocking plate swings, the water outlet hole is divided into at least two areas according to the fan shape to alternately discharge water;

or, the water outlet holes of the water outlet member are arranged circularly, and when the swinging water blocking plate swings, the water outlet holes are divided into at least two areas according to a concentric circle to alternately discharge water;

or, the water outlet holes of the water outlet member are arranged in an array, and when the swinging water blocking plate swings, the water outlet holes in each row are divided into two areas according to odd numbers and even numbers, and water is alternately discharged.

Compared with the prior art, the present invention has the following beneficial effects:

1. The present invention provides a slow area massage water outlet device which is connected with the inlet ends of different water diversion cavity periodically by rotating the water blocking plate or swinging the water blocking plate so that each outlet water area in the water outlet member also showed the purpose of periodic water outlet. Due to the presence of the deceleration, the moving speed of the moving parts are relatively slow, and the switching speed of the water holes is also relatively slow, the outlet water has a strong sense of frustration, so that the feeling of water massage is stronger and the massage effect is better.

2. The invention provides a slow area massage water outlet device, the water outlet hole in the water outlet member can be divided into water outlet areas of various shapes as required, the shape of the water outlet can be customized to a high degree, and the personalized water outlet shape can be easily realized.

3. The present invention provides a slow area massage water outlet device. The reduction ratio of the planetary gear reduction mechanism basically has no effect on the size of the core. By changing the number of teeth in the planetary gear train, the reduction ratio can be doubled or decreased, it has good versatility.

4. The invention provides a slow area massage water outlet device, the planetary gear reduction mechanism has only one degree of freedom of rotation and the movement is more stable, and the planetary gear reduction mechanism can be provided with a spring on the water diversion plate, the sealing is more reliable.

5. The present invention provides a slow area massage water outlet device, which has a richer water outlet configuration and an arbitrary water spray configuration can be achieved as long as the water diversion members can divide the waterway.

6. The present invention provides a slow area massage water outlet device, the rotating water blocking plate or the swinging water blocking plate is also provided with a normally opening in the area where the water sealing surface is located. This small opening helps to relieve pressure, prevent the impeller from jamming, does not affect the overall water flower morphology.

DETAILED DESCRIPTION OF THE PREFERRED EMBODIMENTS

For a fuller explanation of the constitutional composition, technical content, implementation purpose and operation method of the present invention, the following is descriptions with a combination of the embodiments and the accompanying drawings.

Embodiment 1

Figure 1:
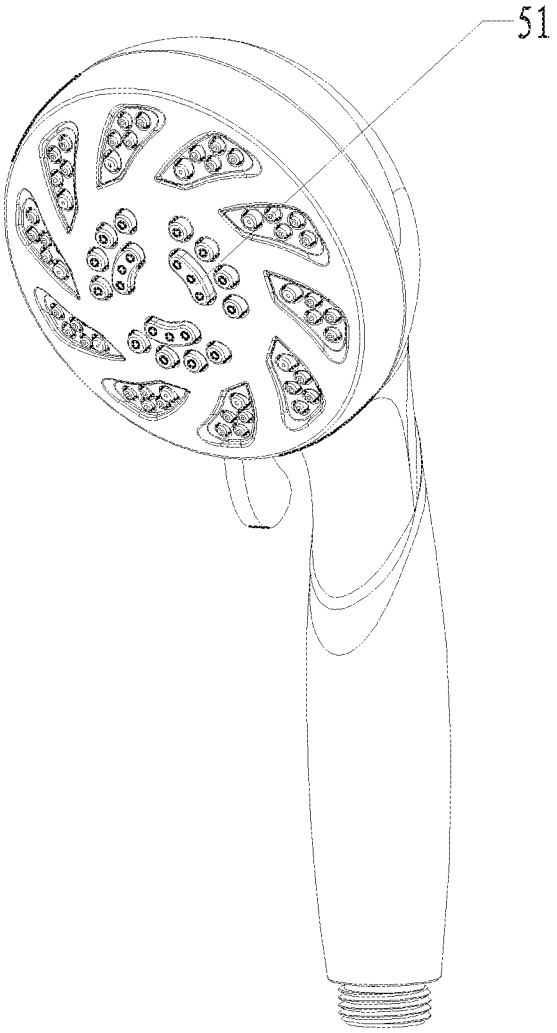
FIG. 1 is an overall schematic view of a showerhead in a preferred embodiment 1 of the present invention.
Figure 2:
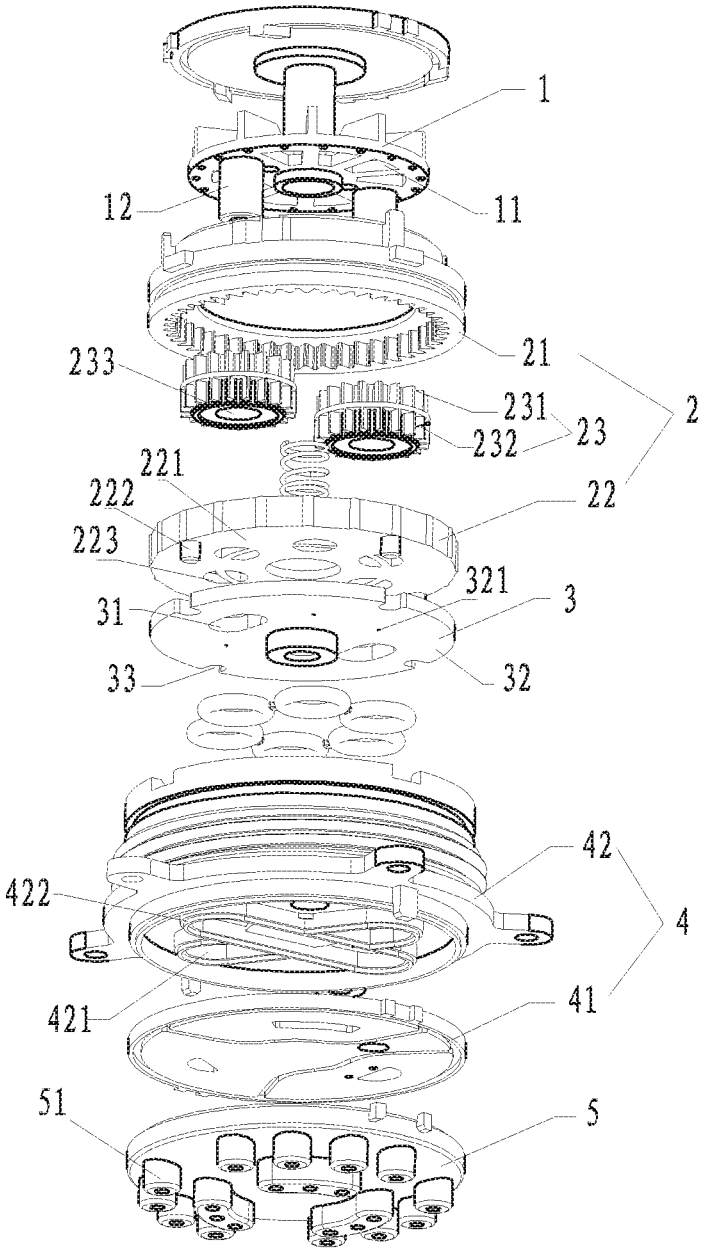
FIG. 2 is an exploded view of the structure of the preferred embodiment 1 of the present invention.
Figure 3:
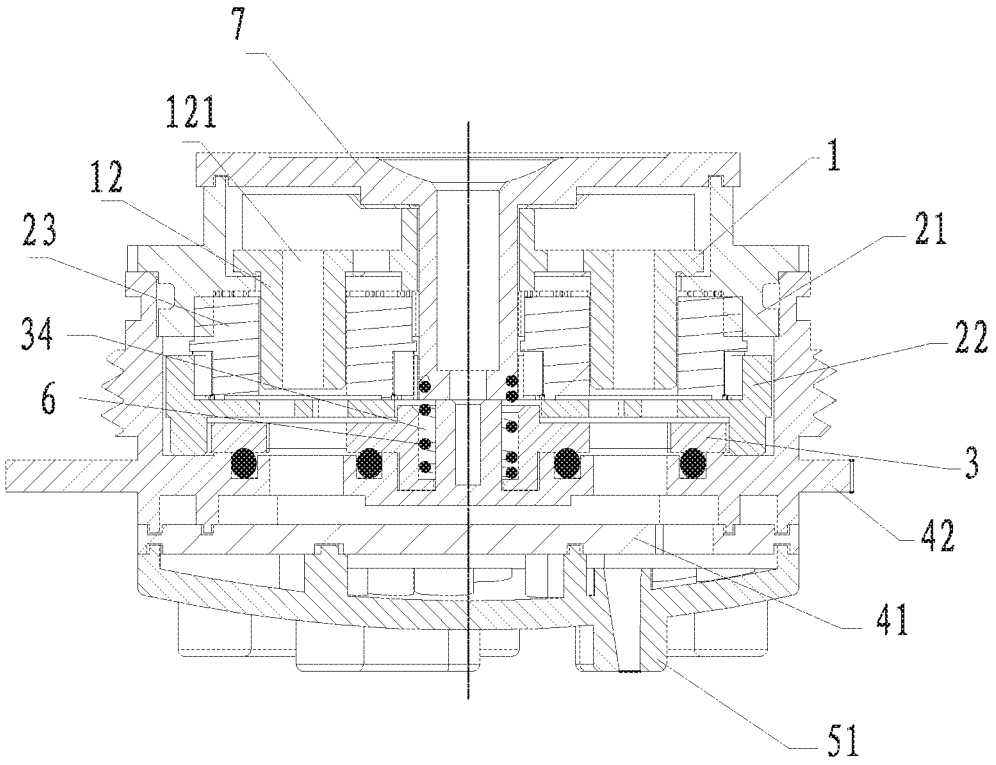
FIG. 3 is a cross-sectional view of the structure of a preferred embodiment 1 of the present invention.
Figure 4:
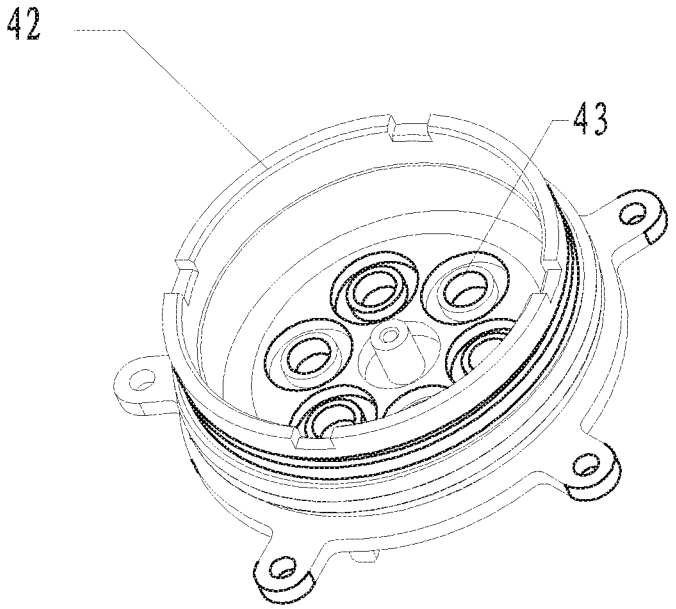
FIG. 4 is a schematic diagram of a water diversion body in the preferred embodiment 1 of the present invention.
Figure 5:
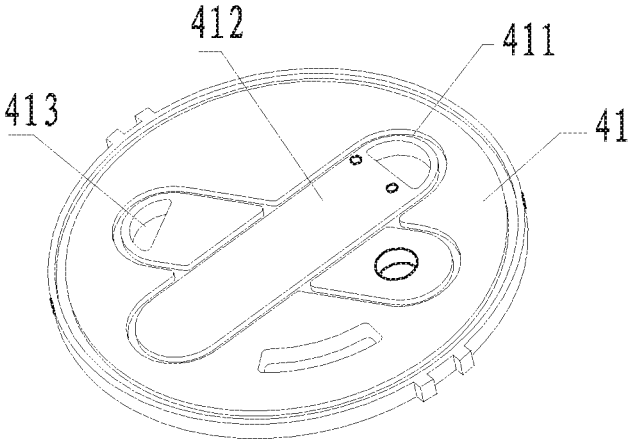
FIG. 5 is a schematic diagram of the water diversion plate according to the preferred embodiment 1 of the present invention.
Figure 6:
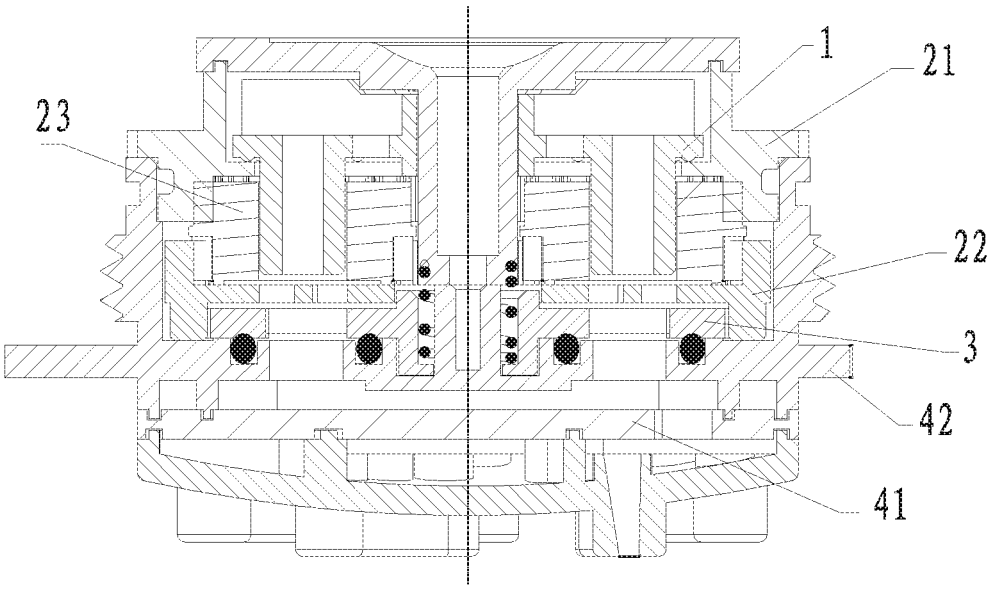
FIG. 6 is a cross-sectional view of the water outlet of the first water outlet area of the preferred embodiment 1 of the present invention.
Figure 7:
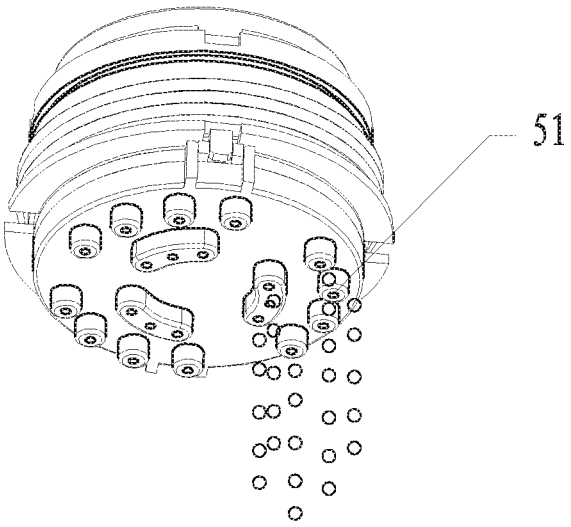
FIG. 7 is a schematic diagram of the water outlet in the first water outlet area of the preferred embodiment 1 of the present invention.
Figure 8:
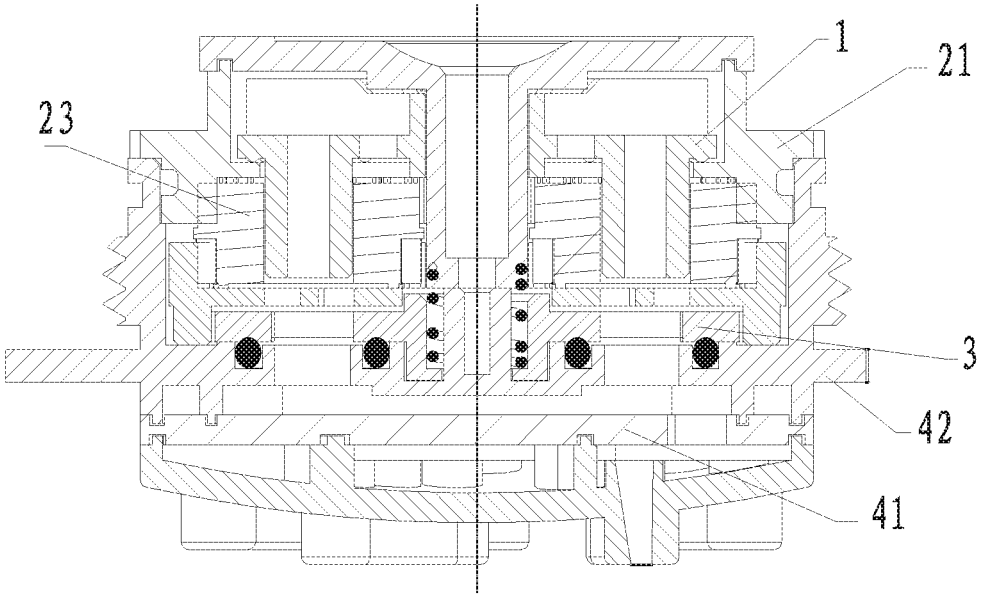
FIG. 8 is a cross-sectional view of the water outlet of the second water outlet area of the preferred embodiment 1 of the present invention.
Figure 9:
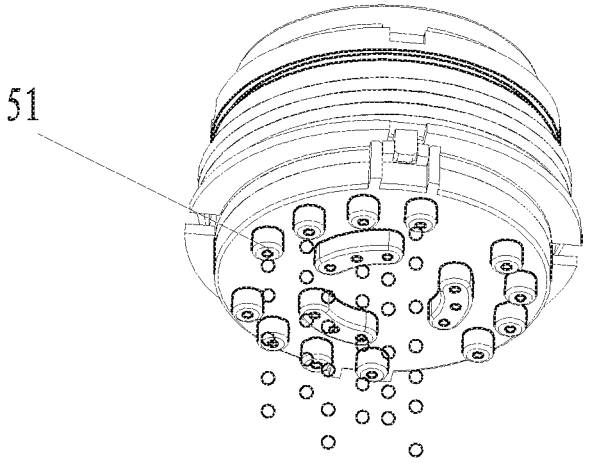
FIG. 9 is a schematic view of the second water outlet region of the preferred embodiment 1 of the present invention when water is discharged.
Figure 10:
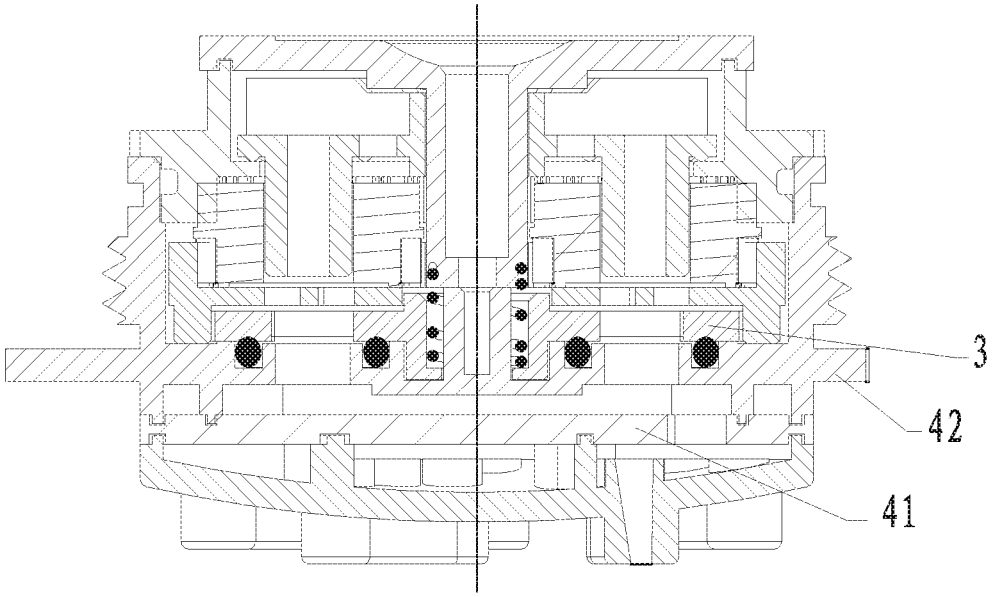
FIG. 10 is a cross-sectional view of the water outlet of the third water outlet area of the preferred embodiment 1 of the present invention.
Figure 11:
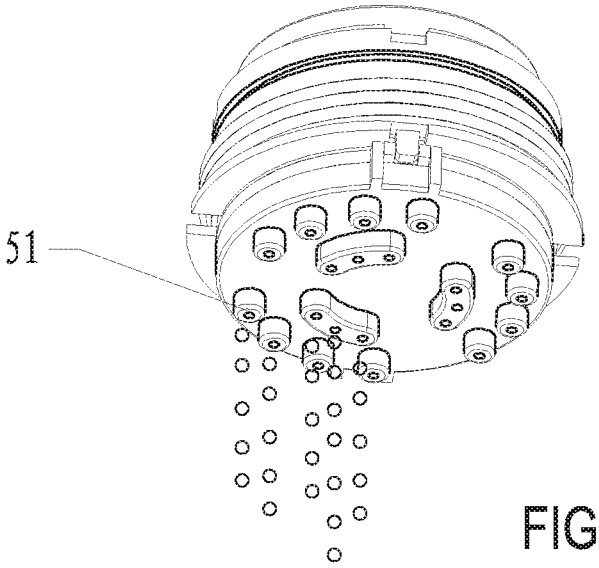
FIG. 11 is a schematic diagram of the water outlet of the third water outlet area in the preferred embodiment 1 of the present invention.

Referring to FIG. 1-11, a slow area massage water outlet device, in this embodiment, is a showerhead, may also be other outlet devices. The shower includes a water flow driving member 1, a speed reducing member 2, a linking member 3, a water dividing member 4 and a water outlet member 5;

the speed reducing member 2 is respectively drivably connected with the water flow driving member 1 and the linking member 3, and the water flow driving member 1 drives the linking member 3 to move by the speed reducing member 2;

the water diversion member 4 has at least two separately isolated water diversion cavities; one end of the water diversion cavity is a water inlet end and the other end is a water outlet end; the water outlet end of each water diversion cavity is respectively communicated with the water outlet hole 51 in different regions of the water outlet member 5;

the linking member 3 has a water inlet 31 and a water sealing surface 32; during the movement of the linking member 3, the water inlet 31 is communicated with the water inlet end of one of the water diversion cavity and the water inlet of the other water diversion cavity toward the water seal surface 32.

The water outlet 31 of the linking member 3 is periodically communicated with the water inlet end of different water diversion cavities so that each water outlet area in the water outlet member 5 also has the purpose of periodically discharging water. Due to the presence of the speed reducing member 2, the moving speed of the linking member 3 is relatively slow, and the switching speed of the water outlet hole 51 is also relatively slow. The water outlet has a relatively strong sense of frustration, so that the feeling of water massage is stronger and the massage effect is better.

In this embodiment, the water flow driving member 1 is an impeller which is provided with a plurality of through holes 11 in the direction of its own rotation axis; the water flow impacts the impeller to drive the impeller to rotate; and the water flows along the through holes 11 toward the water diversion member 4. In this way, this will not only achieve the purpose of water flow to drive the impeller rotation, and the impeller does not hinder the flow of water, and the water flow can normally flow through the through hole 11 to the water dividing part 4.

The speed reducing member 2 is a planetary gear speed reduction mechanism and includes a fixed internal gear 21, a movable internal gear 22 and a planetary gear 23;

the fixed internal gear 21 and the movable internal gear 22 are coaxially disposed, and the movable internal gear 22 is linkedly connected with the linking member 3; the planetary gear 23 is provided with a first gear 231 and a second gear 232 stacked in the axial direction; the first gear 231 meshes with the inner ring gear of the fixed inner gear 21 and the second gear 232 meshes with the inner ring gear of the movable inner gear 22; the linking member 3 and the movable inner gear are provided with a gap; Linking member 3 under different pressure to withstand the downward pressure inconsistently will cause the linking member 3 up and down, the gap makes the linking member 3 up and down floating 3 has no effect on the gear, the speed reducing member 2 has a more stable transmission.

In order to achieve the drive connection of the impeller and the speed reducing member 2, the impeller has a plug column 12 connected with the planetary gear 23, and the planetary gear 23 is provided at the axis with a slot 233 that is mated with the plug column 12, so that the impeller and planetary gear 23 are interlockingly connected; when the impeller rotates, the impeller drives the planetary gear 23 to rotate around the impeller axis. And since the first gear 231 meshes with the inner ring gear of the fixed ring gear 21, the planetary gear 23 rotates about its own axis while traveling in the circumferential direction of the fixed ring gear 21. In addition, since the second gear 232 meshes with the inner ring gear of the movable inner gear 22, the planetary gear 23 also drives the movable inner gear 22 to rotate in the axial direction during the rotation.

A through hole 121 penetrating the impeller is arranged in the plug column 12, and the water flow can flow to the water dividing member through the through hole 121 to reduce the impact of the water pressure during the rotation of the impeller, so that the impeller rotates smoothly and without jamming; the linking member 3 is a rotating water blocking plate which is arranged coaxially with the movable internal gear 22. When the movable internal gear 22 rotates, the rotating water blocking plate is linked and rotated; in order to achieve the above interlocking arrangement, the bottom of the movable inner gear 22 facing the rotating water blocking plate is a baffle 221, and the periphery of the baffle is provided with a plurality of inserting rib 222 so that the outer periphery of the rotating water blocking plate is concave in the radial direction to form the connecting groove 33, the number of the connecting groove 33 corresponds to the inserting rib 222, and the movable internal gear 22 is interlockingly connected with the rotating water blocking plate through the insertion of the inserting rib 222 and the connecting groove 33.

Further, in order to prevent the movable inner gear 22 from blocking the flow of water from the through hole 11, the surface of the baffle 221 is provided with a plurality of through holes 223 in the circumferential direction; the through hole 223 communicates the through hole 11 of the impeller and water outlet 31 of the linking member 3.

In the present embodiment, two water outlet 31 with an included angle of 180° are provided in the rotating water blocking plate, and the remaining positions are the water sealing surfaces 32.

The water diversion member 4 includes a water diversion plate 41 and a water diversion body 42. The water diversion plate 41 is disposed between the water diversion body 42 and the water outlet member 5. the surface of the water diversion plate 41 facing the water dividing body 42 has a groove 411. The groove 411 divides a surface of the water diversion plate 41 facing the water dividing body 42 into at least two areas 412. Each area 412 has an opening 413 therein to form a water outlet end of the water diversion cavity.

The surface of the water diversion body 42 facing the water diversion plate 41 has a cavity 421 corresponding to the area. The side of the water cavity 421 facing the water diversion plate 41 is an open end, and an outer periphery of the open end has a ribs 422 corresponding to the groove 411; the ribs 422 are inserted into the grooves 411 so that the water diversion plate 41 and the water diversion body 42 directly form the water diversion cavity.

In order to ensure that the respective water diversion cavities can be independent of each other and no streaming occurs, at least two water flow passages 43 which are isolated from each other are provided in the water diversion body 42. The water flow passages 43 communicate with the water diversion cavity to form the water inlet end.

In this way, when the water diversion plate is rotated, the water outlet is periodically interlocked with the different water flow channels 43 so that water is periodically taken into each water diversion cavity, so that water can come out of the water outlet holes 51 in different areas of the water output member 5 periodically.

In this embodiment, the number of the water diversion cavity is three, the water outlet holes 51 of the water outlet member 5 are circularly arranged, and are divided into three fan-shaped water outlet areas, and each of the fan-shaped water outlet areas respectively corresponds to one water diversion cavity. When the linking member 3 moves, the three fan-shaped water outlet areas form a massage water outlet effect that periodically alternately discharging water.

Finally, in the present embodiment, the linking member 3 is further provided with a regular opening 321 in a area where the water sealing surface 32 is located, so that the water division cavity toward the water sealing surface 32 still has a small amount of water inflow. In this way, even if the water inlet end of the water diversion cavity is blocked by the sealing surface 32, a part of the water flow will still flow out from the part of the water outlet hole 51 where the water outlet member 5 communicates with the water diversion cavity. The shower also includes a beater 7.

The linking member 3 is provided with a groove 34 at the center. One end of the spring 6 abuts against the bottom of the groove 34 and the other end abuts against the beater 7. The purpose of this arrangement is to ensure that the linking member 3 can be better sealingly connected with the water diversion body 42 under low pressure

Embodiment 2

Figure 12:
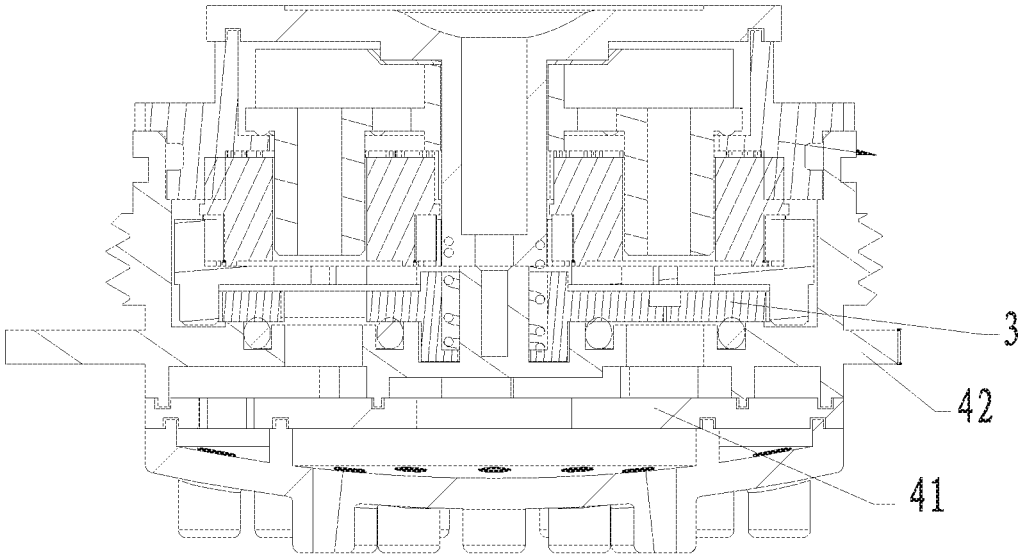
FIG. 12 is a cross-sectional view of the water outlet in the first water outlet area of the preferred embodiment 2 of the present invention.
Figure 13:
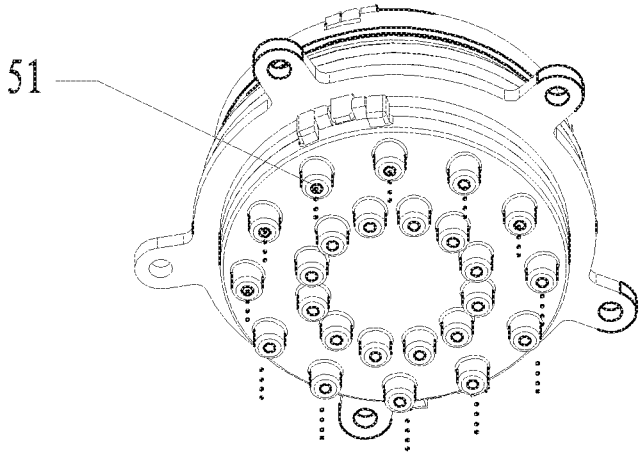
FIG. 13 is a schematic diagram of the water outlet in the first water outlet area of the preferred embodiment 2 of the present invention.
Figure 14:
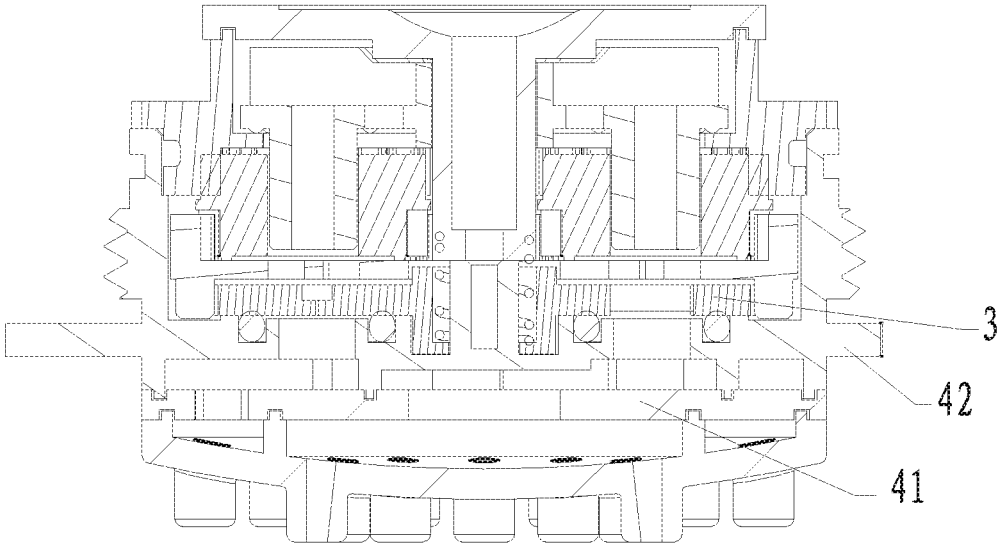
FIG. 14 is a cross-sectional view of the second water outlet area of the preferred embodiment 2 of the present invention when water is discharged.
Figure 15:
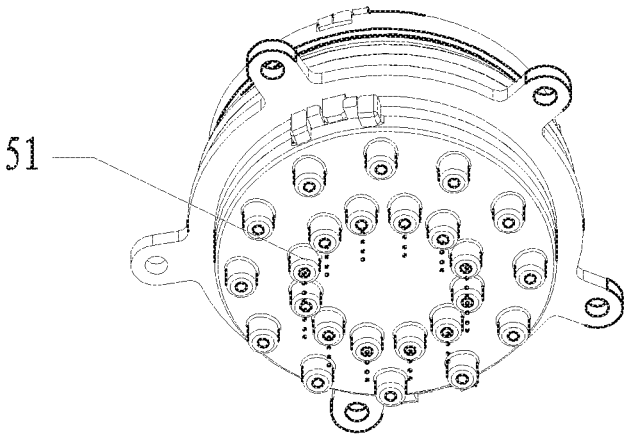
FIG. 15 is a schematic diagram of the water outlet in the second water outlet area of the preferred embodiment 2 of the present invention.

Referring to FIG. 12-15, the difference between this embodiment and embodiment 1 lies in that: the number of the water diversion cavity is two, the water outlet of the water outlet member 5 is circularly arranged, and is divided into two annularly disposed concentric circles water outlet area. Each ring-shaped water outlet area respectively corresponds to a water diversion cavity. When the linking member 3 moves, the two ring-shaped water outlet areas form a massage water outlet effect that periodically alternately discharging water. The rest is the same as that in embodiment 1, and will not be repeated here.

Embodiment 3

Figure 16:
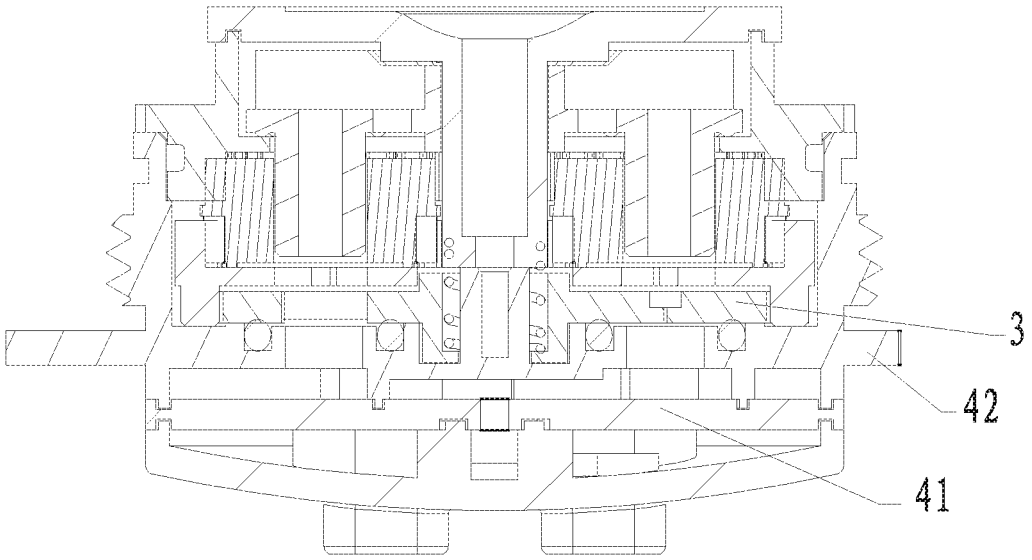
FIG. 16 is a cross-sectional view of the water outlet of the first water outlet area of the preferred embodiment 3 of the present invention.
Figure 17:
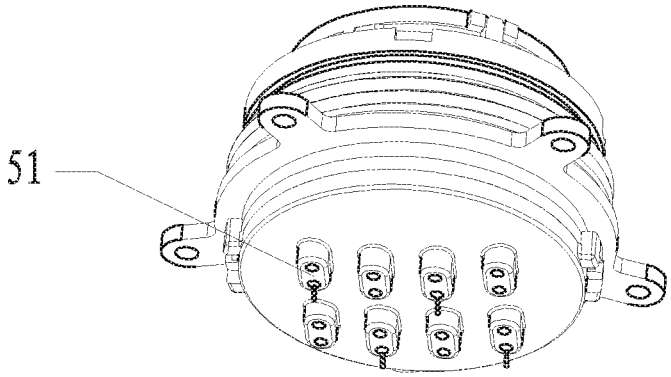
FIG. 17 is a schematic diagram of the water outlet in the first water outlet area of the preferred embodiment 3 of the present invention.
Figure 18:
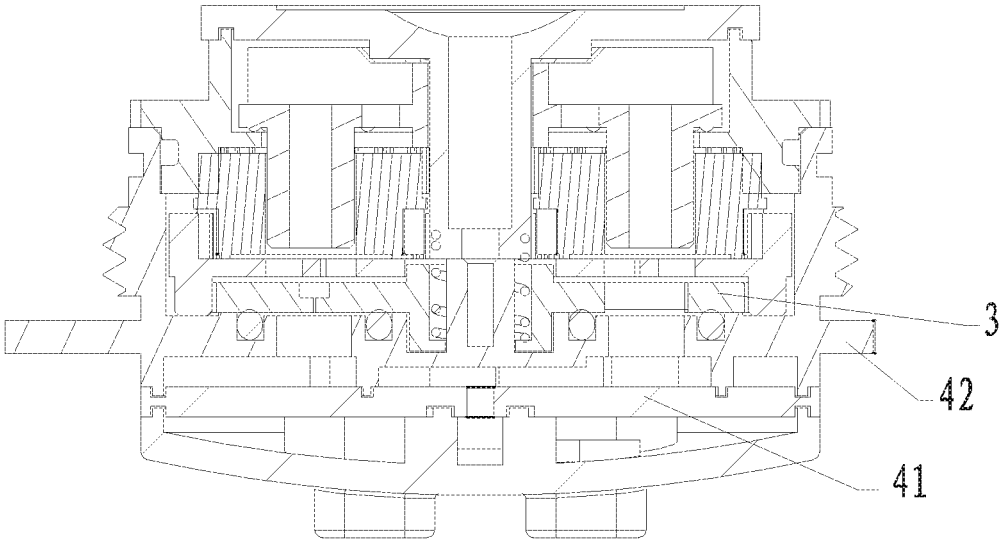
FIG. 18 is a cross-sectional view of the water outlet in the second water outlet area of the preferred embodiment 3 of the present invention.
Figure 19:
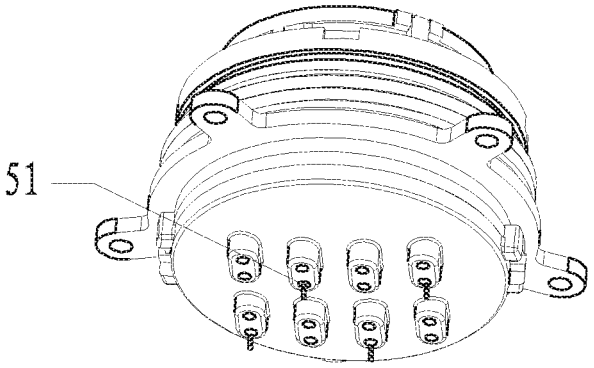
FIG. 19 is a schematic diagram of the water outlet in the second water outlet area of the preferred embodiment 3 of the present invention.

Referring to FIG. 16-19, the difference between this embodiment and embodiment 1 lies in that: the water diversion cavity is two, and the water outlet holes 51 of the water outlet member 5 are arranged in an array. When the linking member 3 moves, the water outlet holes 51 in each row are divided into two areas according to the odd and even numbers to alternately discharge the water; and the water outlet holes of the upper row and the lower row of the simultaneous discharge are staggered.

Embodiment 4

Figure 20:
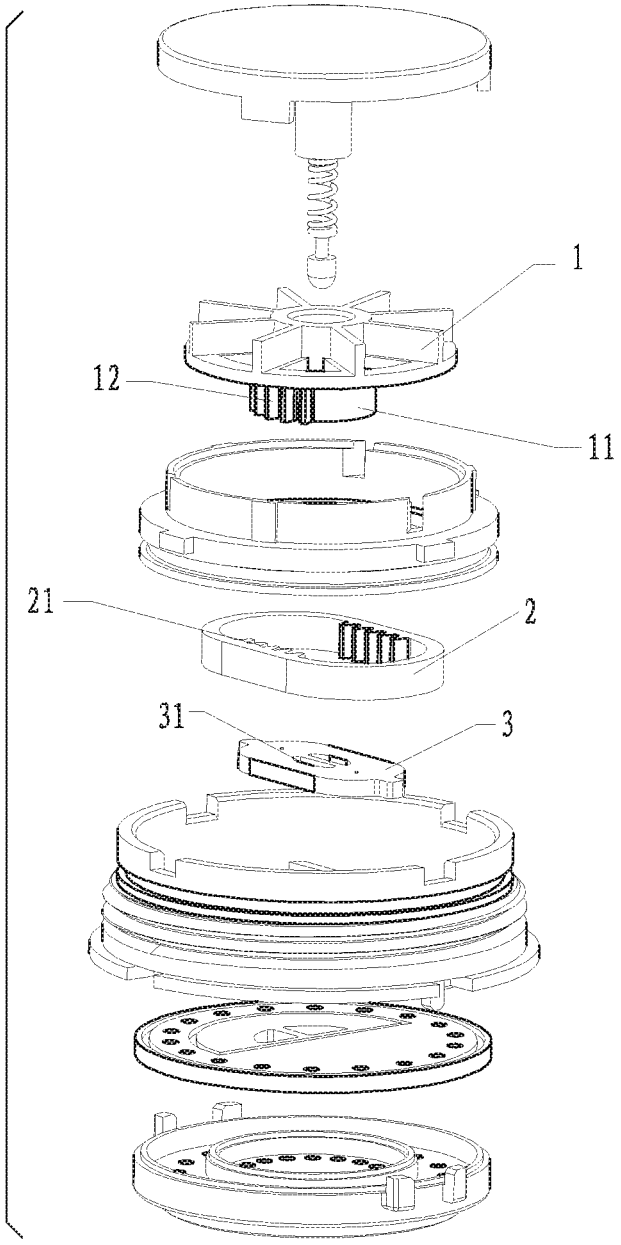
FIG. 20 is an exploded view of the structure of a preferred embodiment 4 of the present invention.
Figure 21:
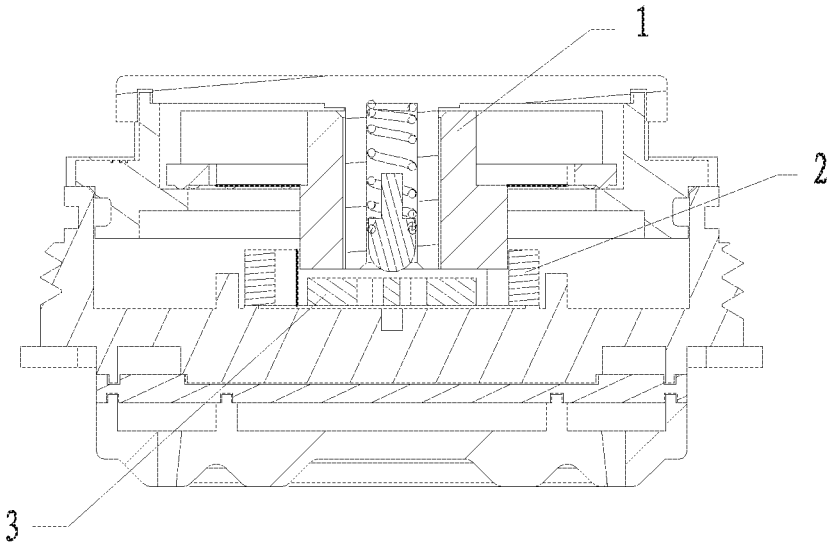
FIG. 21 is a sectional view of the structure of the preferred embodiment 4 of the present invention.
Figure 22:
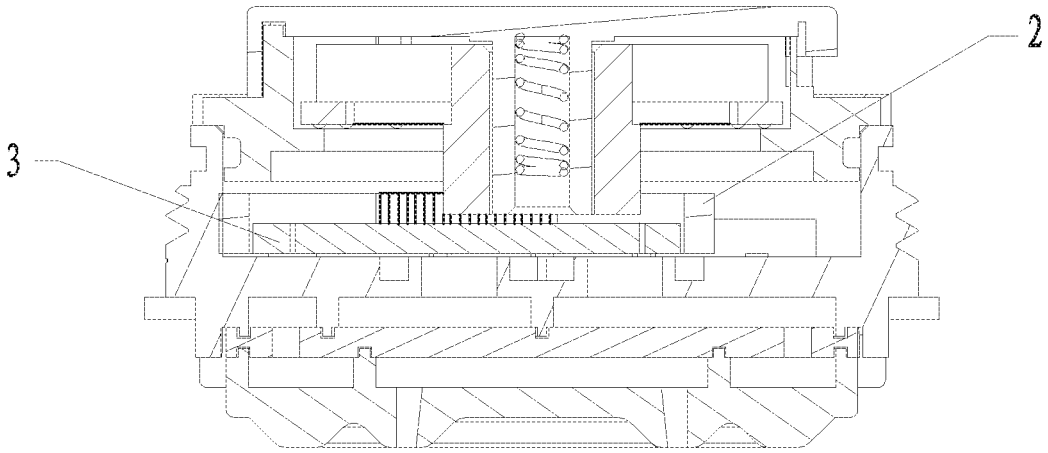
FIG. 22 is a cross-sectional view of the water outlet of the first water outlet area of the preferred embodiment 4 of the present invention.
Figure 23:
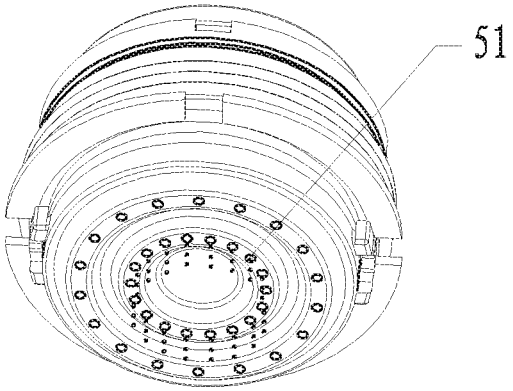
FIG. 23 is a schematic diagram of the water outlet in the first water outlet area of the preferred embodiment 4 of the present invention.
Figure 24:
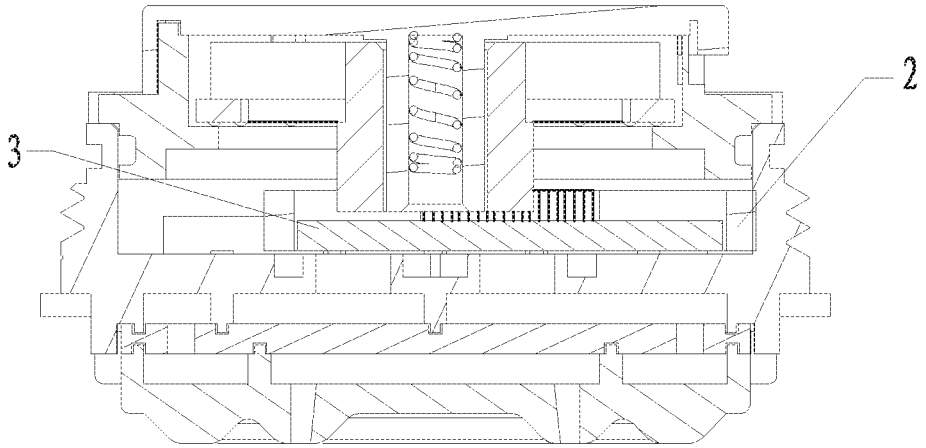
FIG. 24 is a cross-sectional view of the water outlet in the second water outlet area of the preferred embodiment 4 of the present invention.
Figure 25:
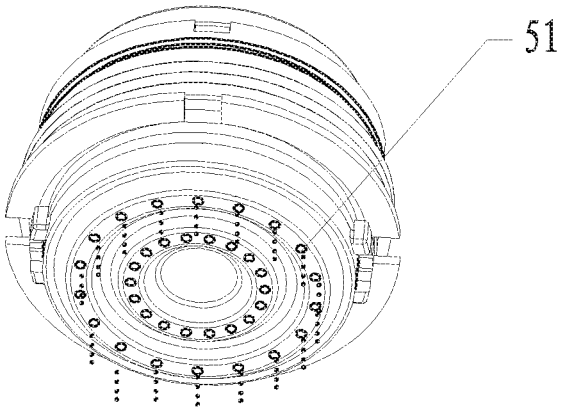
FIG. 25 is a schematic diagram of the water outlet in the second water outlet area of the preferred embodiment 4 of the present invention.

Referring to FIG. 20-25, the difference between this embodiment and embodiment 1 lies in that: the speed reducing member 2 is a racetrack-shaped rack provided with a first tooth tip on the opposite side of the two straight sides of the racetrack type 21; the rest of the rack is a smooth inner wall.

A side surface of the impeller 11 facing the rack extends a convex column 11 at a central axis of the rack, the convex column 11 has a second tooth tip 12 bounded in a part of the side surface thereof and engaged with the first tooth tip 21;

therefore, when the impeller rotates until the first tooth tip 21 engages with the second tooth space 12, the rack is driven to move left and right along the horizontal plane where the rack is located. When the first tooth tip 21 is not engaged with the second tooth tip 12, the rack will not move.

The interlocking member 3 is a swinging water blocking plate; in order to realize the linking swing of the linking member 3 and the rack. Both ends of the swinging water blocking plate are in contact with the inner walls of two circular arc sides of the raceway rack, and when the rack is swung left and right, the swinging water blocking plate then swings left and right.

This structure can also realize the movement of the linking member 3, and realize the communication between the water outlet 31 of the linking member 3 and different water diversion cavities, to realize the water discharge of the water outlet holes 51 in different areas. The configuration of the rest part can be any structure of the embodiment 1, 2, 3, will not be repeated.

The foregoing descriptions are merely exemplary embodiments of the present invention, and therefore, should not be taken as limitations on the scope of the present invention, ie, equivalent changes and modifications based on the scope of the patent and the contents of the specification should be covered by the present invention range.

The invention claimed is:

1. A massage water outlet device, comprising:
an impeller,
a planetary gear speed reduction mechanism,
a rotating water blocking plate,
a water diversion member, and
a water outlet member, wherein:
the impeller comprises a plurality of first through holes disposed in a direction of a rotation axis of the impeller,
water impacts the impeller to drive the impeller to rotate,
the water flows through the plurality of first through holes into the water diversion member,
the planetary gear speed reduction mechanism comprises a fixed internal gear, a movable internal gear, and a planetary gear,
an axis of the fixed internal gear and an axis of the movable internal gear are coaxial,
the movable internal gear is operatively connected to the rotating water blocking plate,
the planetary gear comprises a first gear and a second gear overlapping in an axial direction,
the first gear is engaged with an inner ring gear of the fixed internal gear,
the second gear is engaged with an inner ring gear of the movable internal gear,
the impeller comprises a plug column configured to be disposed in the planetary gear,
an axis of the planetary gear comprises a slot configured to be engaged with the plug column to enable the impeller to be operatively connected to the planetary gear,
the planetary gear rotates about the axis of the planetary gear and along a circumferential direction of the fixed internal gear and drives the movable internal gear to rotate relative to an axial direction of the movable internal gear,
an axis of the rotating water blocking plate and the axis of the movable internal gear are coaxial,
the rotating water blocking plate is operatively connected to the movable internal gear,
the movable internal gear rotates to drive the rotating water blocking plate to rotate,
a bottom of the movable internal gear defines a baffle,
the baffle comprises a plurality of second through holes arranged in a circumferential direction of the baffle,
the plurality of second through holes are configured to enable the plurality of first through holes of the impeller to be connected to a water outlet of the rotating water blocking plate,
the water diversion member comprises at least two independent water diversion cavities,
a first end of each of the at least two independent water diversion cavities is a water inlet end and a second end of each of the at least two independent water diversion cavities is a water outlet end,
the water outlet end of each of the at least two independent water diversion cavities is in communication with a water outlet hole of a corresponding one of different areas of the water outlet member,
the rotating water blocking plate comprises a water sealing surface,
the rotating water blocking plate moves to enable the water outlet of the rotating water blocking plate to be in communication with the water inlet end of one of the at least two independent water diversion cavities, and
the water inlet end of each of the rest of the at least two independent water diversion cavities faces the water sealing surface.

2. The massage water outlet device according to claim 1, wherein the rotating water blocking plate comprises a constant opening disposed on the water sealing surface, so that the water flows into the rest of the at least two independent water diversion cavities through the water sealing surface.

3. The massage water outlet device according to claim 1, wherein:
the water diversion member comprises a water diversion plate and a water diversion body,
the water diversion plate is disposed between the water diversion body and the water outlet member,
a surface of the water diversion plate facing the water diversion body comprises a groove,
the groove divides the surface of the water diversion plate facing the water diversion body into at least two areas,
a surface of the water diversion body facing the water diversion plate comprises a cavity corresponding to the at least two areas,
an outer circumference of the cavity comprises a convex rib configured to be disposed in the groove, and
the convex rib is disposed in the groove so that the water diversion plate and the water diversion body directly define the at least two independent water diversion cavities.

4. The massage water outlet device according to claim 3, wherein:
an inner side of the water diversion body comprises at least two independent water flow channels, and
the at least two independent water flow channels are connected to the at least two independent water diversion cavities to define the water inlet ends.

5. The massage water outlet device according to claim 4, wherein:
the water outlet holes of the water outlet member are circularly disposed, and
when the rotating water blocking plate rotates, the water outlet holes are divided into at least two fan-shaped areas to alternately discharge water.

6. The massage water outlet device according to claim 4, wherein:
the water outlet holes of the water outlet member are concentrically disposed, and
when the rotating water blocking plate rotates, the water outlet holes are divided into at least two concentric circle areas to alternately discharge water.

7. The massage water outlet device according to claim 4, wherein:

the water outlet holes of the water outlet member are disposed in lines and rows, when the rotating water blocking plate rotates, and the water outlet holes in the rows are divided into two areas according to odd numbers of the rows and even numbers of the rows to alternately discharge water.

* * * * *